United States Patent [19]

Law et al.

[11] 3,969,198

[45] July 13, 1976

[54] NI-FE ELECTRO-PLATING

[75] Inventors: Malcolm John Law, Dorking; Peter James Hutchinson, Langley, both of England

[73] Assignee: Permalite Chemicals Ltd., Middlesex, England

[22] Filed: Jan. 9, 1975

[21] Appl. No.: 540,036

[52] U.S. Cl. ..... 204/43 T

[51] Int. Cl.[2] ..... C25D 3/56

[58] Field of Search ..... 204/43 T, 41, 49, 48

[56] References Cited

UNITED STATES PATENTS

| | | | |
|---|---|---|---|
| 2,315,802 | 4/1943 | Lind et al. | 204/49 |
| 2,900,707 | 8/1959 | Brown | 204/49 X |
| 3,546,081 | 12/1970 | Law | 204/49 |
| 3,795,591 | 3/1974 | Clauss et al. | 204/43 T |
| 3,804,726 | 4/1974 | Passal | 204/43 T |
| 3,806,429 | 4/1974 | Clauss et al. | 204/41 |
| 3,812,566 | 5/1974 | Clauss | 204/43 T X |

*Primary Examiner*—G. L. Kaplan

*Attorney, Agent, or Firm*—Dowell & Dowell

[57] ABSTRACT

An electrolyte for electro-plating a base with nickel-iron (Ni-Fe) alloy comprises an aqueous solution containing nickel sulphate, nickel chloride, boric acid, 8 to 16 grams/liter of a ferrous salt, 10 to 30 grams/liter of an alkali metal fluoborate, at least one sulpho-oxygen compound (such as saccharin and/or sodium allyl sulphonate) and a preformed hydrochloride of an amino acetylenic compound. The solution preferably also contains sodium benzene sulphinate or sodium para-toluene sulphinate and/or sodium bisulphite.

3 Claims, No Drawings

NI-FE ELECTRO-PLATING

This invention relates to electroplating with nickel-iron (Ni-Fe) alloy.

Such electroplating has heretofore been used for depositing Ni-Fe alloy on wires, films or other parts for the magnetic characteristics. For example British Patent Specification 1,323,826 describes electroplating Ni-Fe alloy (20% iron) on a magnetic film memory element with an electrolyte consisting of an aqueous solution of nickel sulphate, boric acid, sodium -1.5-naphthalene disulfonate (stress reducer) iron sulphate and sulphuric acid. Also British Patent Specification 304,354 describes the production of very thin sheets of Ni-Fe alloy with up to 21% iron using an electrolyte consisting of nickel sulphate, a much smaller proportion of nickel chloride, iron sulphate, iron chloride, boric acid and sodium sulphate.

The object of the present invention however is not concerned with magnetic characteristics but aims at producing a bright even coating suitable for motor-car parts (e.g. bumper bars) which contain 22–30% iron and have a very high degree of ductility. British Patent Specification 802,503 aims to achieve this result using an electrolyte containing nickel sulfate, a ferrous sulphate, saccharin, sulfated coconut oxyalcohol, boric acid and possibly a small amount of nickel chloride in the absence of saccharin, iron filings being added to reduce ferric ion concentration. However, this process does not appear to have come into commercial use apparently due among other reasons to the difficulty of maintaining the electrolyte in suitable condition for long periods of commercial use. However, the iron content is not stated. Moreover the deposit required to be further plated with bright nickel and chromium to produce a "brilliant mirrorlike surface."

It is therefore, a further object of the present invention to provide an electrolyte which can easily be maintained for long periods of commercial use without further plating. In an article published in "Plating" August 1973 dealing with the production of bright levelled Nickel Iron coatings reference is made on page 805 to the fact that: "Many compounds such as quaternary amines, nitriles and some unsaturated compounds have limited value in Nickel Iron solutions." Whilst there are many compounds which can be used for complexing iron, e.g. carboxylic acids and their salts it is our opinion that if this type of compound is used then in addition to complexing iron you will also complex copper and zinc which are frequent contaminants in Nickel Alloy solutions. If in fact these metals copper and zinc are complexed to any degree this can lead to detrimental results in the plated deposit. See U.S. Pat. No. 3,806,429 for use of these carboxylic acid type complexing agents.

We have found a particular composition of electrolyte which gives highly satisfactory results.

According to the present invention the electrolyte consists of an aqueous solution containing (A) nickel sulphate (B) nickel chloride, (C) boric acid, (D) a ferrous salt, (E) alkali metal fluoborate, (F) at least one of the compounds hereinafter outlined in the Table; (G) and a preformed hydrochloride of an amino compound having either of the following formulae:

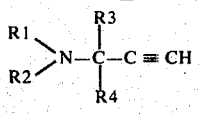

(1)

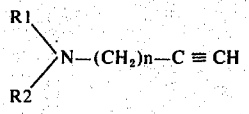

(2)

wherein R1 is alkyl, alkenyl, alkynyl, hydroxy alkyl, alkoxy, alkoxy alkyl, aryl, aralkyl, alkaryl, cycloalkyl, cycloalkenyl, or heterocyclic; R2 is methyl, ethyl, propyl, butyl, alkenyl, alkynyl, hydroxyalkyl, alkoxy, alkoxy alkyl, aryl, aralkyl, alkaryl, cycloakyl, cycloalkenyl or heterocyclic; or where R1 and R2 are joined so that the nitrogen is part of a heterocyclic ring structure; R3 is hydrogen or a methyl or ethyl group, and R4 is hydrogen or an alkyl group containing 1 to 6 carbon atoms providing that if there are more than 2 carbon atoms in R4, R3 is hydrogen; and n is 1, 2 or 3.

TABLE

| | Preferred Proportions |
|---|---|
| 1. Unsaturated aliphatic sulphonic acids, and alkali metal, ammonium, magnesium, and nickel salts thereof e.g. | |
| Sodium vinyl sulphonate $H_2C{=}CHSO_3Na$ | from 2 to 4 g/l |
| Sodium allyl sulphonate $H_2C{=}CHCH_2SO_3Na$ | from 2 to 4 g/l |
| 2. Mononuclear aromatic sulphonic acids, and alkali metal, ammonium, magnesium and nickel salts thereof, e.g. | |
| Benzene monosulphonic acid $C_6H_5SO_3H$ | from 2 to 4 g/l |
| Sodium benzene monosulphonate $C_6H_5SO_3Na$ | from 2 to 4 g/l |
| Nickel benzene monosulphonate $(C_6H_5SO_3)_2Ni$ | from 2 to 4 g/l |
| Sodium para-toluene monosulphonate $CH_3C_6H_4SO_3Na$ | from 2 to 4 g/l |
| Para-chlorobenzene sulphonic acid $ClC_6H_4SO_3H$ | from 2 to 4 g/l |
| Sodium para-chlorobenzene sulphonate $ClC_6H_4SO_3Na$ | from 2 to 4 g/l |
| Sodium para-bromobenzene sulphonate $BrC_6H_4SO_3Na$ | from 2 to 4 g/l |
| 1, 2 Dichlorobenzene sulphonic acid $Cl_2C_6H_3SO_3H$ | from 2 to 4 g/l |
| 1, 2 or 2, 5 Dichlorobenzene sulphonate sodium salt $Cl_2C_6H_3SO_3Na$ | from 2 to 4 g/l |
| Sodium phenylethylene sulphonate $C_6H_5CH{=}CHSO_3Na$ | 1 g/l |
| Meta benzene disulphonic acid $C_6H_4(SO_3H)_2$ | from 2 to 40 g/l |
| Sodium meta-benzene disulphonate $C_6H_4(SO_3Na)_2$ | from 2 to 40 g/l |
| Nickel meta-benzene disulphonate $C_6H_4(SO_3)_2Ni$ | from 2 to 40 g/l |
| Ortho-sulphobenzoic acid monoammonium -salt $HOCOC_6H_4SO_3NH_4$ | 2 g/l |
| 1-Amino-2-, 5-benzene disulphonic acid $H_2NC_6H_3(SO_3H)_2$ | from 2 to 4 g/l |
| Ortho-amino benzene sulphonic acid $H_2NC_6H_4SO_3H$ | from 2 to 4 g/l |
| 3. Mononuclear aromatic sulphinic acids and alkali metal, ammonium, magnesium and nickel salts thereof. | |
| Sodium benzene sulphinate $C_6H_5SO_2Na$ | 005 to 0.5 g/l |
| Sodium para-toluene sulphinate $CH_3C_6H_4SO_2Na$ | 005 to 0.5 g/l |
| 4. Mononuclear aromatic sulphonamides and sulphonimides. | |
| Benzene sulphonamide $C_6H_5SO_2NH_2$ | 1 to 3 g/l |
| Para-toluene sulphonamide $CH_3C_6H_4SO_2NH_2$ | 1 to 3 g/l |
| Ortho-benzoic sulphimide $C_6H_4CONHSO_2$ | 1 to 3 g/l |
| Benzyl sulphonamide $C_6H_5CH_2SO_2NH_2$ | 1 to 3 g/l |
| Benzene sulphydroxamic acid $C_6H_5SO_2NHOH$ | 1 to 3 g/l |
| N,N dimethyl para-toluene sulphonamide $CH_3C_6H_4SO_2N(CH_3)_2$ | 1 to 3 g/l |

TABLE-continued

| | |
|---|---|
| N,N dicarboxyethyl benzene sulphonamide $C_6H_5SO_2N(C_2H_4COOH)_2$ | 1 to 3 g/l |
| 5. Binuclear aromatic sulphonic acids and alkali metal, ammonium, magnesium and nickel salts thereof. | |
| 2-Naphthalene monosulphonic acid $C_{10}H_7SO_3H$ | 1 to 3 g/l |
| 1, 5 or 2, 7-Naphthalene disulphonic acid $C_{10}H_6(SO_3H)_2$ | from 1.5 to 4 g/l |
| 1, 5 or 2, 7-Naphthalene disulphonic acid nickel salt $C_{10}H_6(SO_3)Ni$ | from 1.5 to 3 g/l |
| Naphthalene trisulphonic pp' $C_{10}H_7SO_3H$ | from 1 to 40 g/l |
| Naphthalene trisulphonic acid trisodium salt $C_{10}H_5(SO_3Na)_3$ | from 1 to 40 g/l |
| Diphenyl pp'disulphonic acid $H_6SO_3C_6H_4$ | Up to Saturation (less than 2 g/l) |
| 2-Naphthol-3, 6-disulphonic acid, $HOC_{10}H_5(SO_3H)_2$ | 1 to 4 g/l |
| 2-Naphthol-3, disulphonic acid sodium salt salt $HOC_{10}H_5(SO_3Na)_2$ | 1 to 4 g/l |
| 1-Naphthylamine 3,6,8, trisulphonic acid $H_2N.C_{10}H_4(SO_3H)_3$ | 1 to 4 g/l |
| Dibenzene sulphinimide | 1 to 4 g/l |
| 6. Heterocyclic sulphonic acids and alkali metal, ammonium, magnesium and nickel salts thereof. | |
| Thiophene sulphonic acid $C_4H_3S.SO_3H$ | 0.5 to 1.5 g/l |
| Sodium thiophene sulphonate $C_4H_3S.SO_3Na$ | 0.5 to 1.5 g/l |
| 2-(4-Pyridyl) ethyl sulphonic acid $C_5H_4N.CH_2CH_2SO_3H$ | 1 to 2 g/l |

Concentrations given in the Table above are those at which brilliant nickel-iron deposits were obtained but not necessarily indicating the optimum or maximum concentration.

The nickel sulphate (A) and nickel chloride (B) are preferably each about 60 to 110 grams per liter e.g. 70 to 100 grams/liter.

The boric acid (C) may be 30 to 45 grams/liter e.g. 37.5 to 42.5 grams/liter.

The ferrous salt (D) may be ferrous chloride and/or sulphate and may be 8 to 16 grams/liter e.g. 8 – 12.0 grams/liter.

The fluoborate (E) may be 10 to 30 grams/liter e.g. 15 to 25 grams/liter. Sodium fluoborate is preferred.

The mononuclear aromatic compound (F) may be 1.0 to 2.5 grams/liter e.g. 1.2 to 1.8 grams/liter. This aids ductility.

The unsaturated aliphatic compound (F) may be sodium allyl sulphonate which assists levelling.

The hydrochloride (G) is preferably dimethylamino-propyne hydrochloride. The hydrochloride must be preformed and added to the solution in the form of the hydrochloride. We have proved that the hydrochloride does not ionize into the acetylenic radicle and the chloride radicle in aqueous solution as may be expected from textbook knowledge nor does it give the same result as introducing the amine and hydrochloric acid or chlorides. The dimethylaminoprpyne - hydrochloride may be made as follows:

Mix 4 liters of the acetylenic amine with 1 liter of water, cool to 5°C; add concentrated hydrochloric acid (about 3.5 to 4 liters) to produce a pH of 2.8 to 3.2.

The other hydrochlorides may be made in a similar manner. Such other hydrochlorides are indicated in British Patent Specification No. 1,143,257 e.g. 1-di-ethyl-amino-2 propyne hydrochloride and 3-di-propyl amino-1-propyne hydrochloride. The hydrochloride may be in the proportion 0.001 to 0.2 grams liter preferably 0.005 to 0.05.

We find it very desirable to add to the solution a small quantity of a compound (H) capable of evolution of $SO_2$ in order to militate against the ferrous compound changing to the ferric state due to the common practice of bubbling air through the solution. A suitable compound for this purpose is sodium bisulphate which may be used in the proportion of 0.01 to 0.02 e.g. 0.012 grams/liter.

However, the effect of sodium bisulphite may not continue beyond a few hours and we have found that two other compounds have very good durable results and which can be used as the (H) component viz sodium benzene sulphinate and sodium para-toluene. We find that either of these will materially assist in maintaining a bright Ni-Fe deposit especially at low current density areas.

The plating may be applied direct to steel parts and then be plated with micro-discontinuous chromium plating e.g. as described in British Patent Specification No. 1,289,117.

The deposit can be 75% nickel and 25% iron over the whole plating range of current density.

A wetting agent can be usefully added to the solution to avoid pitting e.g. sodium lauryl ether sulphate, or sodium 2-ethyl hexyl sulphate.

A particular solution was as follows:

Example 1

| | | |
|---|---|---|
| Nickel Sulphate | 75 | grams/liter |
| Nickel Chloride | 75 | grams/liter |
| Boric acid | 43.75 | grams/liter |
| Ferrous sulphate | 9.38 | grams/liter |
| Saccharine | 1.5 | grams/liter |
| Sodium allyl sulphonate | 3 | grams/liter |
| Sodium fluoborate | 12.0 | grams/liters |
| The pH was 2.8 to 3.5 | | |
| The plating temperature was 60 – 70°C. | | |
| Dimethyl amino propyne hydrochloride | 0.0012 | grams/liter |

A further slution was as follows:

Example II

| | | |
|---|---|---|
| Nickel Sulphate | 85.0 | grams/liter |
| Nickel Chloride | 70.0 | grams/liter |
| Boric Acid | 40.0 | grams/liter |
| Ferrous Sulphate | 10.5 | grams/liter |
| Naphthalene Tri-Sulphonic Acid | 2.5 | grams/liter |
| Sodium Fluoborate | 15.0 | grams/liter |
| Sodium Allyl Sulphonate | 2.5 | grams/liter |
| pH. | 2.8 | |
| Temperature | 65°C. | |
| Diethyl amino-propyne Hydrochloride | 0.001 | grams/liter |
| Benzene Sulphinic acid Sodium Salt | 0.015 | grams/liter |

The deposit obtained was very bright and lustrous and had remarkable ductility e.g. could be bent around a small radius of less than one inch without any signs of cracking.

When other acetylenic compounds were tried, e.g. the ethoxylated derivatives of butyne diol and propargyl alcohol, the ductility of the deposited metal coating obtained was not as good as when using the acetylenic amine hydrochlorides.

In general the pH should not be allowed to rise above 3.8. The pH can be lowered by adding hydrochloride acid or sulphuric acid or can be raised by adding nickel carbonate e.g. on a filter.

The anodes may be titanium baskets containing nickel squares with for example one basket out of ten containing Fe chips. Also we can use carbon nickel anodes or depolarised nickel anodes. Nickel and iron chips should not be mixed in the same basket.

The solution may be continuously filtered through a carbon pack to give one complete volume filtration per hour.

The solution in accordance with this invention functions well over a convenient range of concentrations giving uniform bright ductile and well levelled deposits.

The saccharine and sodium fluoborate are gradually used up during plating and suitable additions may be made from time to time.

We claim:

1. An electrolyte having a pH value not exceeding 3.8 for electroplating a base with nickel iron (Ni-Fe) alloy containing 22 to 30% iron comprising an aqueous solution of:

A. nickel sulphate 60 to 110 grams/liter;

B. nickel chloride 60 to 110 grams/liter;

C. boric acid 30 to 45 grams/liter;

D. 8 to 16 grams/liter of a ferrous salt;

E. 10 to 30 grams/liter of an alkali metal fluoborate;

F. an amount effective to yield a bright nickel-iron coating of at least one compound selected from the group consisting of 1. unsaturated aliphatic sulphonic acids, and the alkali metal, ammonium, magnesium, and nickel salts thereof;
2. mononuclear aromatic sulphonic acids and the alkali metal, ammonium, magnesium and nickel salts thereof;
3. monuclear aromatic sulphonamides and sulphonimides;
4. binuclear aromatic sulphonic acids and alkali metal, ammonium, magnesium and nickel salts thereof; and
5. heterocyclic sulphonic acids and alkali metal, ammonium, magnesium and nickel salts thereof;

G. 0.001 to 0.2 grams/liter of a hydrochloride of an amino compound having either of the following formulae:

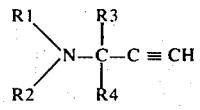

(1)

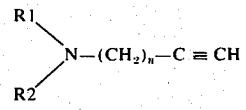

(2)

wherein R1 is alkyl, alkenyl, alkynyl, hydroxy alkyl, alkoxy, alkoxy alkyl, aryl, aralkyl, alkaryl, cycoalkyl, cycloalkenyl, or heterocyclic; R2 is methyl, ethyl, propyl, butyl, alkenyl, alkynyl, hydroxyalkyl, alkoxy, alkyl, aryl, aralkyl, alkaryl, cycloalkyl, cycloalkenyl or heterocyclic; or where R1 and R2 are joined so that the nitrogen is part of a heterocyclic ring structure; R3 is hydrogen or a methyl or ethyl group, and R4 is hydrogen or an alkyl group containing 1 to 6 carbon atoms providing that if there are more than 2 carbon atoms in R4, R3 is hydrogen; and n is 1, 2 or 3; and H. a minor proportion effective to prevent oxidation of the ferrous ion to the ferric state of a compound selected from the group consisting of sodium bisulphite, sodium benzene sulphinate and sodium paratoluene sulphinate.

2. The electrolyte of claim 1 in which the (F) component is a combination of sodium allyl sulphonate and saccharin or a combination of sodium allyl sulphonate and naphthalene tri-sulphonic acid.

3. The electrolyte of claim 1 in which the (H) component is sodium bisulphite.

* * * * *